US007475731B2

(12) United States Patent
Victor

(10) Patent No.: US 7,475,731 B2
(45) Date of Patent: Jan. 13, 2009

(54) SAND PLUNGER

(75) Inventor: Bruce M. Victor, Fort Lupton, CO (US)

(73) Assignee: Production Control Services, Inc., Frederick, CO (US)

( * ) Notice: Subject to any disclaimer, the term of this patent is extended or adjusted under 35 U.S.C. 154(b) by 173 days.

(21) Appl. No.: 11/105,753

(22) Filed: Apr. 14, 2005

(65) Prior Publication Data

US 2005/0230120 A1 Oct. 20, 2005

Related U.S. Application Data

(60) Provisional application No. 60/562,634, filed on Apr. 15, 2004.

(51) Int. Cl.
*E21B 43/12* (2006.01)
*E21B 33/08* (2006.01)

(52) U.S. Cl. ..... 166/372; 166/177.3; 166/153; 166/105; 166/68

(58) Field of Classification Search ..... 166/177.3, 166/372, 153, 170, 175, 176, 105, 107, 68; 417/56

See application file for complete search history.

(56) References Cited

U.S. PATENT DOCUMENTS 1,588,705 A * 6/1926 Cope et al. ..... 417/459
2,635,554 A * 4/1953 Haley ..... 417/554
2,714,855 A 8/1955 Brown ..... 103/52
3,181,470 A * 5/1965 Clingman ..... 417/56
3,861,471 A 1/1975 Douglas
4,007,784 A * 2/1977 Watson et al. ..... 166/170
4,502,843 A * 3/1985 Martin ..... 417/56
4,629,004 A * 12/1986 Griffin ..... 166/372
4,712,981 A 12/1987 Gramling William D.
5,253,713 A 10/1993 Gregg et al. ..... 166/372
5,333,684 A 8/1994 Walter et al.
5,431,229 A 7/1995 Christensen
5,868,554 A * 2/1999 Giacomino et al. ..... 417/56
6,148,923 A 11/2000 Casey ..... 166/372
6,176,309 B1 1/2001 Bender ..... 166/68
6,200,103 B1 * 3/2001 Bender ..... 417/56
6,273,690 B1 8/2001 Fischer, Jr. et al.
6,325,152 B1 12/2001 Kelley et al.
6,467,541 B1 10/2002 Wells
6,543,543 B2 4/2003 Muth (Continued)

FOREIGN PATENT DOCUMENTS

CA 2 428 618 A1 11/2004

(Continued)

OTHER PUBLICATIONS

"Solid, Bar Stock Bullet Plungers", www.pcsplungerlift.com, Feb. 9, 1999, 2 pages.*

(Continued)

*Primary Examiner*—Shane Bomar
(74) *Attorney, Agent, or Firm*—Aileen Law; A Law Firm, P.C.

(57) ABSTRACT

A plunger mechanism comprising radial peripheral holes extending outwardly from a center core to an outer surface through which a downhole gas may pass to clear an obstruction on the outer surface of the plunger, thereby enabling a self-cleaning action.

10 Claims, 5 Drawing Sheets

U.S. PATENT DOCUMENTS

| | | | | |
|---|---|---|---|---|
| 6,554,580 | B1 | 4/2003 | Mayfield et al. | |
| 6,591,737 | B2 | 7/2003 | Giacomino | 92/193 |
| 6,637,510 | B2 | 10/2003 | Lee | |
| 6,644,399 | B2 * | 11/2003 | Abbott et al. | 166/68 |
| 6,669,449 | B2 | 12/2003 | Giacomino | 417/56 |
| 6,705,404 | B2 | 3/2004 | Bosley | 166/372 |
| 6,725,916 | B2 | 4/2004 | Gray et al. | |
| 6,746,213 | B2 | 6/2004 | Giacomino | 417/56 |
| 6,907,926 | B2 | 6/2005 | Bosley | 166/108 |
| 6,945,762 | B2 | 9/2005 | Williams | 417/546 |
| 7,121,335 | B2 * | 10/2006 | Townsend | 166/105 |
| 7,191,838 | B2 * | 3/2007 | Reitz | 166/372 |
| 7,314,080 | B2 * | 1/2008 | Giacomino | 166/105 |
| 2002/0066572 | A1 | 6/2002 | Muth | 166/369 |
| 2002/0162662 | A1 | 11/2002 | Passamaneck et al. | |
| 2003/0141051 | A1 | 7/2003 | Abbott et al. | |
| 2003/0155116 | A1 * | 8/2003 | Gray et al. | 166/107 |
| 2003/0155129 | A1 | 8/2003 | Gray et al. | |
| 2003/0215337 | A1 | 11/2003 | Lee | |
| 2004/0129428 | A1 | 7/2004 | Kelley | 166/372 |
| 2006/0054329 | A1 * | 3/2006 | Chisholm | 166/372 |
| 2006/0065390 | A1 * | 3/2006 | Amies et al. | 166/105 |
| 2006/0185853 | A1 * | 8/2006 | Bender | 166/372 |

FOREIGN PATENT DOCUMENTS

| | | |
|---|---|---|
| RU | 2225502 | 3/2004 |

OTHER PUBLICATIONS

"The Viper", Well Master Corporation, http://www.wellmaster.com/The%20Viper%20v1%20-%20Web%20Res.pdf, undated, 1 page.*

Well Master Corporation, "Viper Plunger", http://www.wellmaster.com/productsPLsolidViper.htm, 2006, 1 page.*

Green, David, Well Master Corporation, http://www.wellmaster.com/NewsViperOct06.htm, Oct. 30, 2006, 2 pages.*

Bruce M. Victor, U.S. Appl. No. 10/803,373, "Multi-Part Plunger" filed Mar. 18, 2004.

Jeffrey L. Giacomino, U.S. Appl. No. 11/071,148, "Thermal Actuated Plunger" filed Mar. 3, 2005.

Jeffrey L. Giacomino, U.S. Appl. No. 11/060,513, "Data Logger Plunger" filed Feb. 17, 2005.

Bruce M. Victor, U.S. Appl. No. 11/110,447, "Variable Orifice Bypass Plunger" filed Apr. 20, 2005.

Bruce M. Victor, U.S. Appl. No. 11/010,168, "Internal Shock Absorber Bypass Plunger" filed Dec. 10, 2004.

Bruce M. Victor, "Liquid Aeration Plunger", U.S. Appl. No. 11/124,805, filed May 9, 2005; complete copy of specification, drawings and filing receipt attached hereto.

MGM Well Service, Inc., Pacemaker Plunger, Co., P.O. Box 270924, Corpus Christi, TX 78427-0924 Pacemaker Plunger Variations Internet marketing material, Feb. 12, 2003.

* cited by examiner

SAND PLUNGER

CROSS REFERENCE APPLICATIONS

This application is a non-provisional application claiming the benefits of provisional application No. 60/562,634 filed Apr. 15, 2004.

FIELD OF ART

The present invention relates to a plunger lift apparatus for the lifting of formation liquids in a hydrocarbon well. More specifically the plunger comprises a self-cleaning plunger apparatus that operates to increase the well efficiency in a sand-bottomed well.

BACKGROUND

A plunger lift is an apparatus that is used to increase the productivity of oil and gas wells. In the early stages of a well's life, liquid loading is usually not a problem. When rates are high, the well liquids are carried out of the well tubing by the high velocity gas. As a well declines, a critical velocity is reached below which the heavier liquids do not make it to the surface and start to fall back to the bottom exerting back pressure on the formation, thus loading up the well. A plunger system is a method of unloading gas in high ratio oil wells without interrupting production. In operation, the plunger travels to the bottom of the well where the loading fluid is picked up by the plunger and is brought to the surface removing all liquids in the tubing. The plunger also keeps the tubing free of paraffin, salt or scale build-up.

A plunger lift system works by cycling a well open and closed. During the open time, a plunger interfaces between a liquid slug and gas. The gas below the plunger will push the plunger and liquid to the surface. This removal of the liquid from the tubing bore allows an additional volume of gas to flow from a producing well. A plunger lift requires sufficient gas presence within the well to be functional in driving the system. Oil wells making no gas are thus not plunger lift candidates.

As the flow rate and pressures decline in a well, lifting efficiency declines geometrically. Before long the well begins to "load up". This is a condition whereby the gas being produced by the formation can no longer carry the liquid being produced to the surface. There are two reasons this occurs. First, as liquid comes in contact with the wall of the production string of tubing, friction occurs. The velocity of the liquid is slowed, and some of the liquid adheres to the tubing wall, creating a film of liquid on the tubing wall. This liquid does not reach the surface. Secondly, as the flow velocity continues to slow, the gas phase can no longer support liquid in either slug form or droplet form. This liquid along with the liquid film on the sides of the tubing begin to fall back to the bottom of the well. In a very aggravated situation, there will be liquid in the bottom of the well with only a small amount of gas being produced at the surface. The produced gas must bubble through the liquid at the bottom of the well and then flow to the surface. Because of the low velocity, very little liquid, if any, is carried to the surface by the gas. Thus, a plunger lift will act to remove the accumulated liquid.

A typical installation plunger lift system 100 can be seen in FIG. 1. Lubricator assembly 10 is one of the most important components of plunger system 100. Lubricator assembly 10 includes cap 1, integral top bumper spring 2, striking pad 3, and extracting rod 4. Extracting rod 4 may or may not be employed depending on the plunger type. Contained within lubricator assembly 10 is plunger auto catching device 5 and plunger sensing device 6.

Sensing device 6 sends a signal to surface controller 15 upon plunger 200 arrival at the well top. Plunger 200 can represent the plunger of the present invention or other prior art plungers. Sensing the plunger is used as a programming input to achieve the desired well production, flow times and wellhead operating pressures.

Master valve 7 should be sized correctly for the tubing 9 and plunger 200. An incorrectly sized master valve 7 will not allow plunger 200 to pass through. Master valve 7 should incorporate a full bore opening equal to the tubing 9 size. An oversized valve will allow gas to bypass the plunger causing it to stall in the valve.

If the plunger is to be used in a well with relatively high formation pressures, care must be taken to balance tubing 9 size with the casing 8 size. The bottom of a well is typically equipped with a seating nipple/tubing stop 12. Spring standing valve/bottom hole bumper assembly 11 is located near the tubing bottom. The bumper spring is located above the standing valve and can be manufactured as an integral part of the standing valve or as a separate component of the plunger system. Fluid accumulating on top of plunger 200 may be carried to the well top by plunger 200.

Surface control equipment usually consists of motor valve (s) 14, sensors 6, pressure recorders 16, etc., and an electronic controller 15 which opens and closes the well at the surface. Well flow 'F' proceeds downstream when surface controller 15 opens well head flow valves. Controllers operate on time, or pressure, to open or close the surface valves based on operator-determined requirements for production. Modern electronic controllers incorporate features that are user friendly, easy to program, addressing the shortcomings of mechanical controllers and early electronic controllers. Additional features include: battery life extension through solar panel recharging, computer memory program retention in the event of battery failure and built-in lightning protection. For complex operating conditions, controllers can be purchased that have multiple valve capability to fully automate the production process.

Modern plungers are designed with various sidewall geometries and can be generally described as follows:

A. Shifting ring plungers for continuous contact against the tubing to produce an effective seal with wiping action to ensure that all scale, salt or paraffin is removed from the tubing wall. Some designs have by-pass valves to permit fluid to flow through during the return trip to the bumper spring with the by-pass shutting when the plunger reaches the bottom. The by-pass feature optimizes plunger travel time in high liquid wells.

B. Pad plungers have spring-loaded interlocking pads in one or more sections. The pads expand and contract to compensate for any irregularities in the tubing, thus creating a tight friction seal. Pad plungers can also have a by-pass valve as described above.

C. Brush plungers incorporate a spiral-wound, flexible nylon brush section to create a seal and allow the plunger to travel despite the presence of sand, coal fines, tubing irregularities, etc. By-pass valves may also be incorporated.

D. Solid plungers have solid sidewall rings for durability. Solid sidewall rings can be made of various materials such as steel, poly materials, Teflon®, stainless steel, etc. Once again, by-pass valves can be incorporated.

E. Snake plungers are flexible for coiled tubing and directional holes, and can be used as well in straight standard tubing.

FIGS. 2A, 2B, 2C and 2D are side views of various plunger mandrel embodiments. All geometries described have an internal orifice.

A. As shown in FIG. 2C, plunger mandrel 20 is shown with solid ring 22 sidewall geometry. Solid sidewall rings 22 can be made of various materials such as steel, poly materials, Teflon®, stainless steel, etc. Inner cut grooves 30 allow sidewall debris to accumulate when a plunger is rising or falling.

B. As shown in FIG. 2D, plunger mandrel 80 is shown with shifting ring 81 sidewall geometry. Shifting rings 81 allow for continuous contact against the tubing to produce an effective seal with wiping action to ensure that all scale, salt or paraffin is removed from the tubing wall. Shifting rings 81 are individually separated at each upper surface and lower surface by air gap 82.

C. As shown in FIG. 2A, plunger 60 has spring-loaded interlocking pads 61 in one or more sections. Interlocking pads 61 expand and contract to compensate for any irregularities in the tubing, thus creating a tight friction seal.

D. As shown in FIG. 2B, plunger 70 incorporates a spiral-wound, flexible nylon brush 71 surface to create a seal and allow the plunger to travel despite the presence of sand, coal fines, tubing irregularities, etc.

Recent practices toward slim-hole wells that utilize coiled tubing also lend themselves to plunger systems. Because of the small tubing diameters, a relatively small amount of liquid may cause a well to load-up, or a relatively small amount of paraffin may plug the tubing.

Plungers use the volume of gas stored in the casing and the formation during the shut-in time to push the liquid load and plunger to the surface. This plunger lift occurs when the motor valve opens the well to the sales line or to the atmosphere. To operate a plunger installation, only the pressure and gas volume in the tubing/casing annulus is usually considered as the source of energy for bringing the liquid load and plunger to the surface.

The major forces acting on the cross-sectional area of the bottom of the plunger are:

- The pressure of the gas in the casing pushes up on the liquid load and the plunger.
- The sales line operating pressure and atmospheric pressure push down on the plunger.
- The weight of the liquid and the plunger weight itself push down on the plunger.
- Once the plunger begins moving to the surface, friction between the tubing and the liquid load acts to oppose the plunger.
- In addition, friction between the gas and tubing acts to slow the expansion of the gas.

In certain wells, the well bottom consists of sand. FIG. 1A (prior art) is a blow up schematic of a well bottom section 600 showing accumulated water 17 and sand 13 trapped within inner cut grooves 30. Sand 13 tends to cake up within the inner cut grooves 30 and on the sidewall rings 22 of the plunger which will hinder the plunger operation. Solid ring plungers tend to get sand between each sidewall ring 22. Shifting ring, pad or brush plungers can also tend to cake with sand. When plungers are caked with sand, they tend to get caught within the aforementioned lubricator and may require manual intervention (maintenance). In addition, a major disadvantage of using prior art plunger lifts in a sandy well is that these plungers will cake with sand and fail to fall, or fall too slowly, to the bottom of the well. When plunger drop travel time slows, well production can be limited. Also, fishing a plunger out of a well can be a problem and may sometimes require the pulling of the complete tubing string.

What is needed is a plunger lift apparatus that is capable of being used in a sand-bottom well and which cleans itself. A clean plunger results in continuous efficiency. It drops back to the well bottom quickly and easily, where it can assist in increasing lift cycle times, thereby optimizing well production. What is also needed is a self-cleaning plunger system for sandy wells that may be retrievable from the well. The apparatus of the present invention provides a solution to these aforementioned issues.

SUMMARY OF THE DISCLOSURE

One aspect of the present invention is to provide a self-cleaning plunger apparatus for use in a sand-bottom well.

Another aspect of the present invention is to provide a plunger apparatus that will lift sand away from a well bottom during the plunger lift from the well, rise to the well top where it cleans itself and allow any accumulated sand to be blown away from its sides and taken downstream for further separation and cleanout.

Another aspect of the present invention is to allow the plunger to clean itself at the top of the lift so the plunger may efficiently force fall inside the tubing to the well-hole bottom without a decrease in speed that could impede well production.

Yet another aspect of the present invention is to provide a self-cleaning plunger that will help keep the well clean.

Another aspect of the present invention is to allow for various plunger mandrels and/or sidewall types to be utilized.

Other aspects of this invention will appear from the following description and appended claims, reference being made to the accompanying drawings forming a part of this specification wherein like reference characters designate corresponding parts in the several views.

The present invention comprises a plunger lift apparatus having an elongate body with a solid top (typically a fishing neck design), and a hollow central region. In the case of a solid ring mandrel, a plurality of exit holes extend from between the annular solid rings to the hollow central region. The self-cleaning sand plunger functions to carry sand, other solids and fluids from the bottom of the well to the surface. Once at the well top the plunger can be auto-caught. It will be held in the plunger auto catcher located within the lubricator. While held in the auto catcher, well pressure will force gas up through its hollowed out central core and out through the peripheral holes, functioning to clean out any sand that is caught in the outer annular grooves, thus creating a self-cleaning function. The well control system will release it to fall back into the well when conditions are satisfied. One having skill in the art would know that a caked plunger could be held at the well top by the gas pressure in the well without actually being auto-caught. As stated above, the plunger can clean itself at the top of the lift. Sand that is cleaned from the annular grooves is subsequently carried downstream by the well pressure flow and into a separating station.

The cleaned plunger will be dropped back into the well when well conditions are met with all liquid loading factors. Self-cleaning allows the plunger to efficiently force fall back to the well bottom. In addition, self-cleaning helps to keep the plunger from getting caught in the lubricator due to accumulated sand, thereby lessening/avoiding maintenance.

The disclosed device optimizes well efficiency due to the fact that it is self-cleaning which allows it to quickly travel to the well bottom.

Before explaining the disclosed embodiments in detail, it is to be understood that the device is not limited in its application to the details of the particular arrangement shown, since the device is capable of other embodiments. Also, the terminology used herein is for the purpose of description and not of limitation.

DETAILED DESCRIPTION OF THE DRAWINGS

Figure 1:
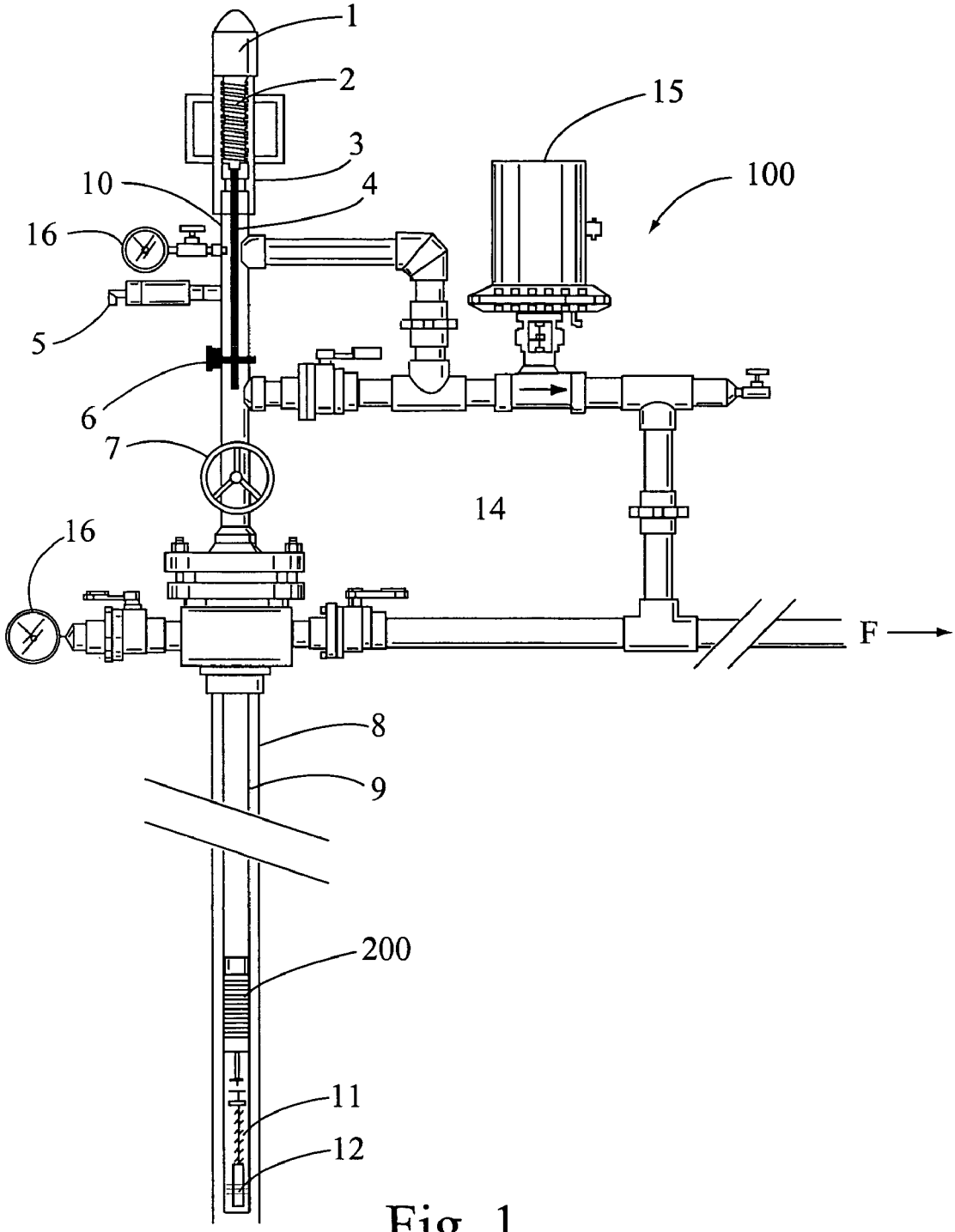
Fig. 1 (PRIOR ART)
FIG. 1 (prior art) is an overview depiction of a typical plunger lift system installation.
Figure 1A:
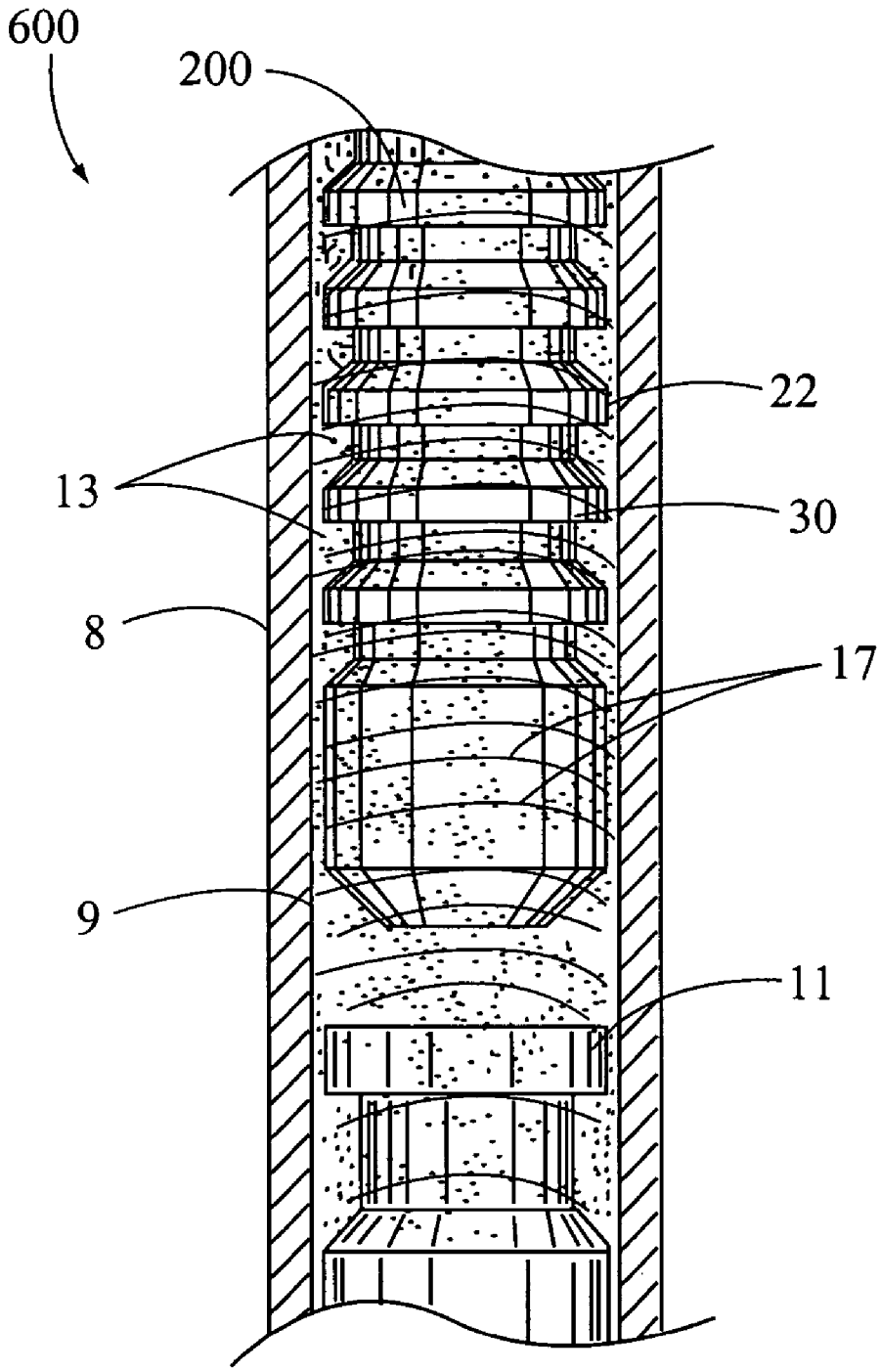
Fig. 1A (PRIOR ART)
FIG. 1A (prior art) is a blow up drawing of a well bottom having accumulated sand.
Figure 2A:
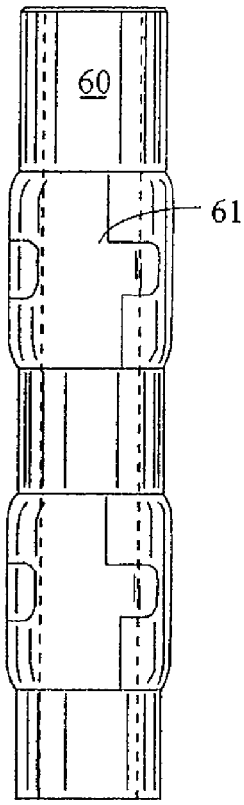
Fig. 2A (PRIOR ART)
FIGS. 2A, 2B, 2C, and 2D (prior art) are side views of various standard types of plunger sidewalls available in the industry.
Figure 2B:
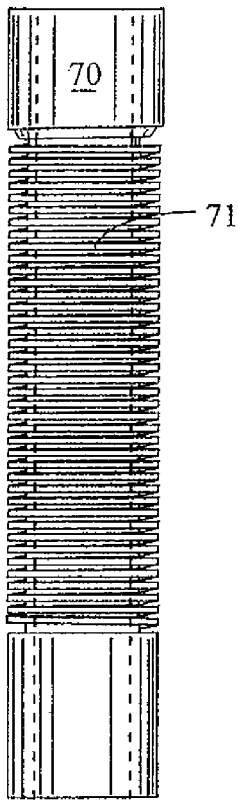
Fig. 2B (PRIOR ART)
Figure 2C:
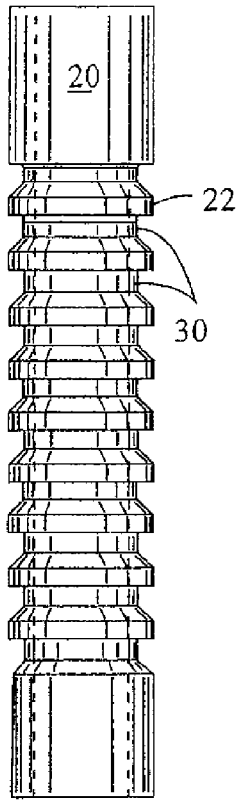
Fig. 2C (PRIOR ART)
Figure 2D:
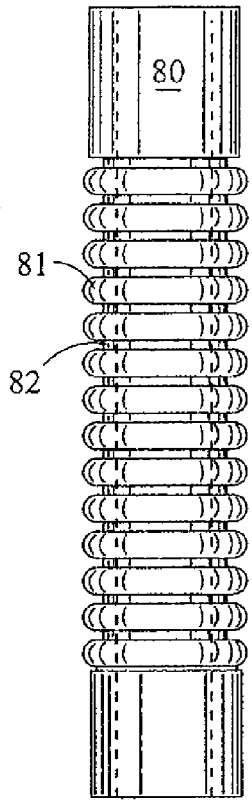
Fig. 2D (PRIOR ART)

In sandy-bottomed wells, sand can typically accumulate on the outside of a plunger similar to that shown in FIG. 1A. Accumulations comprising sand can impede plunger drop to the well bottom. In addition, the plunger may get stuck within the auto-catcher or the tubing which would require manual intervention or maintenance, thus raising operational costs and/or lessening well production.

The disclosed device provides for a plunger apparatus that can be used in sand bottom based gas wells. Plunger 300 is a self-cleaning plunger apparatus capable of lifting sand away from a well bottom during the plunger lift from the well, cleaning itself at the well top by pushing accumulated sand out and away from itself and allowing the accumulated sand to be blown out and taken downstream for further separation and cleanout prior to its fall back to the well bottom. The disclosed device thus helps to keep the well clean and avoids getting itself stuck within the well. When conditions are met, plunger 300 is allowed to fall down into the well tubing to the well bottom. Plunger 300 can be employed with various solid plunger sidewall geometries.

Figure 3:
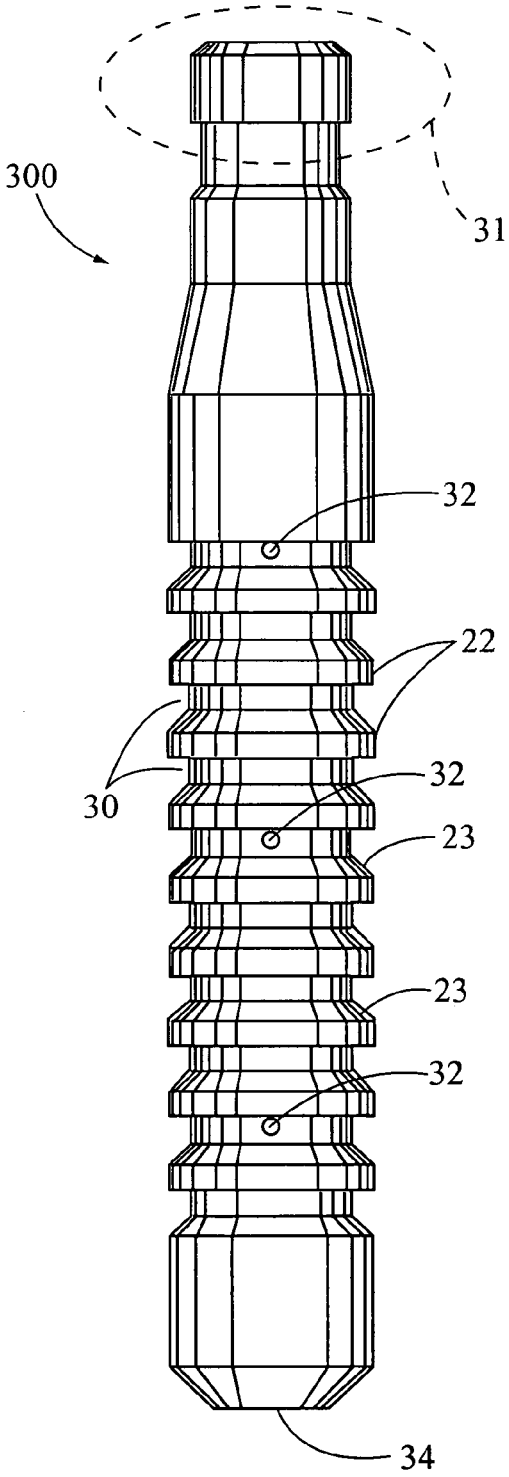
FIG. 3 is a side plan view of one embodiment of the present invention showing the sand plunger with solid ring sidewall geometry.
Figure 4:
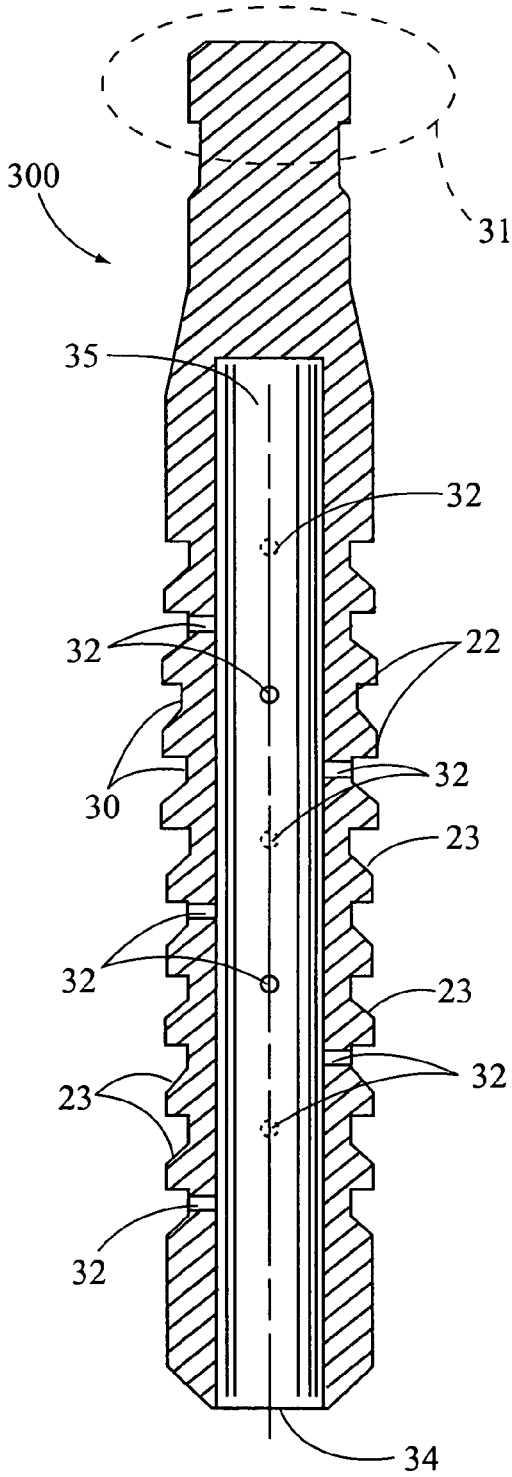
FIG. 4 is a longitudinal cross-sectional view of the embodiment of FIG. 3.

FIGS. 3,4 show peripheral radial clean out holes 32 extending from a central inner core 35 to radial grooves 30. Gas, under well pressure, enters bottom entry 34, passes up through inner core 35, and exits out through radial clean out holes 32 while plunger 300 is at the well top. The plunging action blows any sand that is embedded (trapped or caked) in radial grooves 30 away from plunger 300. Sand can be swept by the well pressure in direction F (ref. FIG. 1) to a separator where it is subsequently separated from liquids and gas. In this manner, not only is sand removed from the well bottom, but plunger 300 is also cleaned for efficient and continued drops back to the well bottom. Plunger 300 comprises a fluid/gas dynamic shape to allow it to pass to the well bottom at an efficient speed until it comes to rest on the well bottom or on a bumper spring.

The plunger illustrated in FIGS. 3,4 comprises a plurality of rings that are spaced along most of the plunger's length. The rings help to scrape sand and scale as well as paraffin and other debris from the tubing during plunger travel. These accumulations are typically caught in inner cut grooves 30 as a plunger rises or falls. FIG. 3 is a side view of one embodiment of the disclosed device wherein the annular rings are solid rings. Solid rings 22 are undercut along the bottom surface of the ring. The undercut may be a straight undercut as shown which traps gas. Solid rings 22 can comprise a downward slant top surface 23. The rings can comprise various materials such as steel, poly materials, Teflon®, stainless steel, etc.

Holes 32 extend radially from core 35 (ref. FIG. 4) to grooves 30. Core 35 can extend from bottom entry 34 to at least the top of its outer ringed surface or the last inner groove 30. Radial holes 32 form about a 90° angle with respect to the length of the core. Other embodiments of the disclosed device can employ any suitable number and angle of radial holes. Locations of the holes can also vary along with the type of surface geometry. Standard American Petroleum Institute (API) fishing neck 3 at the top end of the sand plunger is a well known design in the art and allows retrieval of plunger 300 from the well if necessary. Typical solid plungers include, but are not limited to, hollow steel symmetrical shaped bullet plungers, plungers having Teflon® or poly sleeves, solid steel plungers with under-cut grooves, solid steel plungers with top cut grooves to hold fluid and bottom cut grooves to trap gas.

FIG. 4 is a side cross-sectional view of the embodiment shown in FIG. 3. Well pressure will force gas into bottom entry 34, up through core 35 and out one or more radial holes 32, thus enabling a self-cleaning 'venturi-like' action to remove sand and any other accumulated debris from grooves 30.

Figure 5:
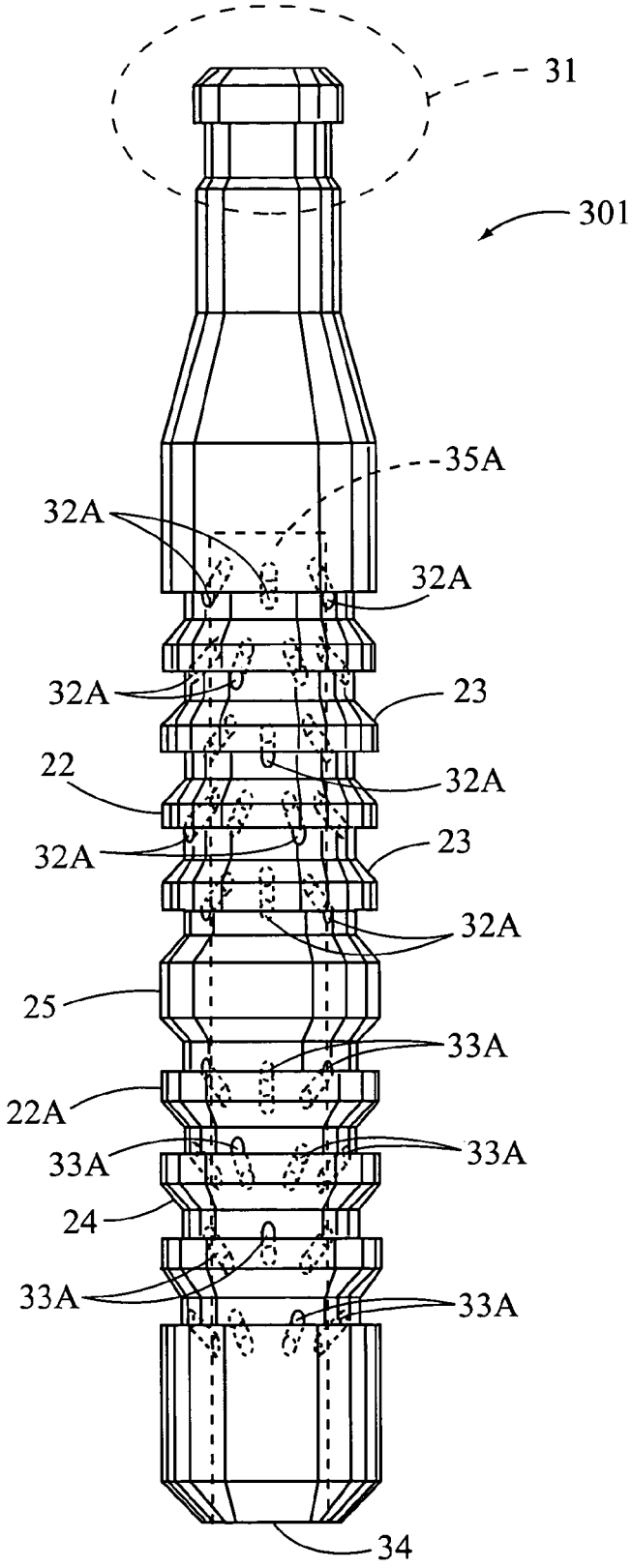
FIG. 5 is a side plan view of a sand plunger having a double symmetry sidewall design.

FIG. 5 is an alternate embodiment having a double symmetry design. The upper half of plunger 301 comprises solid rings 22 having a downward slant top surface 23. The bottom half of plunger 301 comprises solid rings 22A having an upward slant surface 24. Mid outer ring 25 of the disclosed device splits the upper half from the bottom half. The design of the upper half acts to trap gas whereas the lower half acts to scrape the tubing sidewall as the plunger rises. In this embodiment, gas enters core 35A through bottom entrance 34 and exits out radial holes 32A positioned at the upper half of the plunger. Gas also may exit out of radial holes 33A positioned at the lower half to cause self-cleaning of any caked sand accumulated around the annular plunger grooves. It should be noted that this alternate embodiment is depicted with radial holes 32A at about an upward 45° angle to the radial axis versus a 90° angle as previously shown in FIGS. 3,4. Radial holes 33A are shown at a downward 45° angle to the radial axis. It should also be noted that radial holes 32A, 33A could be manufactured at various angles, including the radial angle shown in FIGS. 3,4, and still provide a self-cleaning action, resulting in movement of sand downstream to a separator and significantly less well maintenance.

During lift, the disclosed device acts as a sealed device which carries sand and fluids to the well surface. The gas flow out the holes creates a 'venturi tube' type effect. The accumulated square inch cross-sectional area of the combined holes 32 as compared to the square inch cross-sectional area of the bottom centered out hollow core 35 is critical. If the ratio of the cross-sectional area of the combined holes 32 CA exceeds a critical point, it will cause lift failure and/or not self-clean. In one experiment a sixteen inch long sand plunger had a one inch bottom hole. One hundred twenty holes were made at one eighth inch diameter each. A particular liquid load could not be lifted that day.

The disclosed device basically is employed as follows:

1. Plunger 300 drops to the bottom of a well. While an amount of liquid loads on top of the plunger, sand may accumulate on the outer plunger surfaces, typically within annular grooves 30.
2. The well is open for flow whereby the pressure in the tubing above the plunger is reduced and the different pressure at the opposite ends of the plunger cause plunger 300 to rise upwardly through the tubing string towards the well top to lift liquids and accumulated sand out of the well bore.
3. Plunger 300 is caught within the lubricator at the well top by the plunger auto-catcher device (ref. FIG. 1). Note: the extracting rod shown in FIG. 1 would not be used with the plunger as it has a solid top (typically a fishing neck). As stated above, the plunger can clean itself at the top of the lift.
4. The well flows for a set time or condition controlled by the well-head controller, at which time the plunger's self-cleaning action begins.
5. While plunger 300 is held by the auto-catcher, well pressure forces gas into the plunger's bottom entry 34, inner core 35, and out of radial holes 32. Pressurized gas coming out of radial holes 32 creates a 'venturi tube' effect functioning to blow sand out and away from grooves 30.
6. Sand is carried in direction F (ref. FIG. 1) by the well pressure to a separator.
7. If the plunger is auto-caught, the auto-catcher releases plunger 300 after a set time or condition as controlled by the well system controller.
8. With the accumulated sand removed, plunger 300 falls to the well bottom more efficiently, to rest at the well bottom while liquids and sand accumulate.
9. The well plunger lift cycle starts again.

It should also be noted that other alternate embodiments of the disclosed device could be easily employed by one skilled in the art to accomplish the self-cleaning aspect of the disclosed device. Alternate embodiments could employ various sidewalls, various numbers of radial holes, various locations of the holes within the outer grooves, and various angles extending from the inner core to the peripheral surface of the plunger and still accomplish the self-cleaning aspect of the disclosed device.

Although the disclosed device has been described with reference to preferred embodiments, numerous modifications and variations can be made and still the result will come within the scope of the disclosure. No limitation with respect to the specific embodiments disclosed herein is intended or should be inferred.

I claim:

1. A plunger apparatus for use in a hydrocarbon well having a sand content, said plunger comprising:

a body having a top end and a bottom end;

said bottom end in fluid communication with a hollow core extending the longitudinal length of said body;

a plurality of exit holes extending radially and outwardly from a substantial portion of said hollow core's length to a peripheral surface of said body; and one or more of said plurality of exit holes capable of permitting a downhole gas flowing through said hollow core to clear an accumulation comprising sand from at least a portion of said peripheral surface.

2. The plunger of claim 1, wherein said peripheral surface further comprises one or more solid rings, shifting rings, pads, or bristles.

3. The plunger of claim 1, wherein said one or more exit holes are positionable between a pair of solid rings.

4. The plunger of claim 1, wherein said top end further comprises a fish neck.

5. The plunger of claim 1, wherein said one or more of said exit holes form an angle of about 90° from an inner wall of said hollow core.

6. The plunger of claim 1, wherein said longitudinal body is capable of being formed as an integral one-piece unit.

7. The plunger of claim 1, wherein one or more of said plurality of exit holes are positionable at a top portion of said longitudinal body, said top portion holes further comprising a downward slant from an inner wall of said hollow core toward said peripheral surface.

8. The plunger of claim 1, wherein one or more of said plurality of exit holes are positionable at a lower portion of said longitudinal body, said lower portion holes further comprising an upward slant from an inner wall of said hollow core toward said peripheral surface.

9. The plunger of claim 7, wherein one or more of said plurality of exit holes are positionable at a lower portion of said longitudinal body, said lower portion holes further comprising an upward slant from said inner wall of said hollow core toward said peripheral surface.

10. A method of clearing downhole accumulations from a plunger, the method comprising the steps of:

providing a plunger comprising a mandrel having an upper end, a lower end, and a fluid channel extending the longitudinal length of said mandrel, said fluid channel in communication with one or more holes extending radially and outwardly from a substantial portion of said channel length and to a peripheral surface of said plunger;

positioning said plunger in a well tubing;

allowing said plunger to ascend in said well tubing and carry liquids and downhole accumulations to a well top;

allowing a downhole gas to flow through said fluid channel portion and said one or more holes to clear said downhole accumulations from at least a portion of said peripheral surface of said plunger.

* * * * *